US006185382B1

(12) United States Patent
Knott et al.

(10) Patent No.: US 6,185,382 B1
(45) Date of Patent: Feb. 6, 2001

(54) PROCESSING MACHINE WITH A TEMPERATURE SENSOR

(75) Inventors: Joseph Knott, Tutzing; Peter Thiemann, Munich; Peter Bremmer, Roehrmoos, all of (DE)

(73) Assignee: Océ Printing Systems GmbH, Poing (DE)

( * ) Notice: Under 35 U.S.C. 154(b), the term of this patent shall be extended for 0 days.

(21) Appl. No.: 09/284,763

(22) PCT Filed: Oct. 20, 1997

(86) PCT No.: PCT/DE97/02432

§ 371 Date: Jul. 6, 1999

§ 102(e) Date: Jul. 6, 1999

(87) PCT Pub. No.: WO98/18059

PCT Pub. Date: Apr. 30, 1998

(30) Foreign Application Priority Data

Oct. 22, 1996 (DE) ..... 196 43 631

(51) Int. Cl.[7] ..... G03G 15/00
(52) U.S. Cl. ..... 399/44
(58) Field of Search ..... 399/38, 44, 46, 399/53, 91, 92, 94, 222, 252, 254, 258

(56) References Cited

U.S. PATENT DOCUMENTS 4,888,618 * 12/1989 Ishikawa ..... 399/44 X
5,034,772 * 7/1991 Suzuki ..... 399/44
5,038,170 * 8/1991 Serita ..... 399/92
5,095,333 * 3/1992 Shimada ..... 399/92
5,144,366 * 9/1992 Sakamoto et al. ..... 399/92
5,191,362 * 3/1993 Ichikawa ..... 399/44 X
5,530,556 * 6/1996 Miura et al. ..... 399/44 X
5,689,766 * 11/1997 Hollar et al. ..... 399/92

FOREIGN PATENT DOCUMENTS 38 18 352 A1 12/1988 (DE) .
2 273 790 6/1994 (GB) .
63-142378 * 6/1988 (JP) .

OTHER PUBLICATIONS

Japanese Abstract, Publication No. 09160473, Publication Date Jun. 20, 1997.
Japanese Abstract, Publication No.58083875, Publication Date May 19, 1983.
Japanese Abstract, Publication No.63142378, Publication Date Jun. 14, 1988.
Japanese Abstract, Publication No.03172876, Publication Date Jul. 26, 1991.
Japanese Abstract, Publication No.62050851, Publication Date Mar. 5, 1987.
Japanese Abstract, Publication No.62127776, Publication Date Jun. 10, 1987.
Japanese Abstract, Publication No.04134364, Publication Date May 8, 1992.
Japanese Abstract, Publication No.63144371, Publication Date Jun. 16, 1988.

* cited by examiner

*Primary Examiner*—Sandra Brase
(74) *Attorney, Agent, or Firm*—Schiff Hardin & Waite

(57) ABSTRACT

A printer or copier has a developer station which uses a developer mix such as tone and developer. A temperature sensor is provided in the developer station to sense the temperature of the developer mix. The signal of the temperature sensor is fed to a control unit which effects a control of the copier or printer operation, such as by halting operation, effecting cooling, or triggering a warning signal when the temperature reaches an upper boundary.

13 Claims, 1 Drawing Sheet

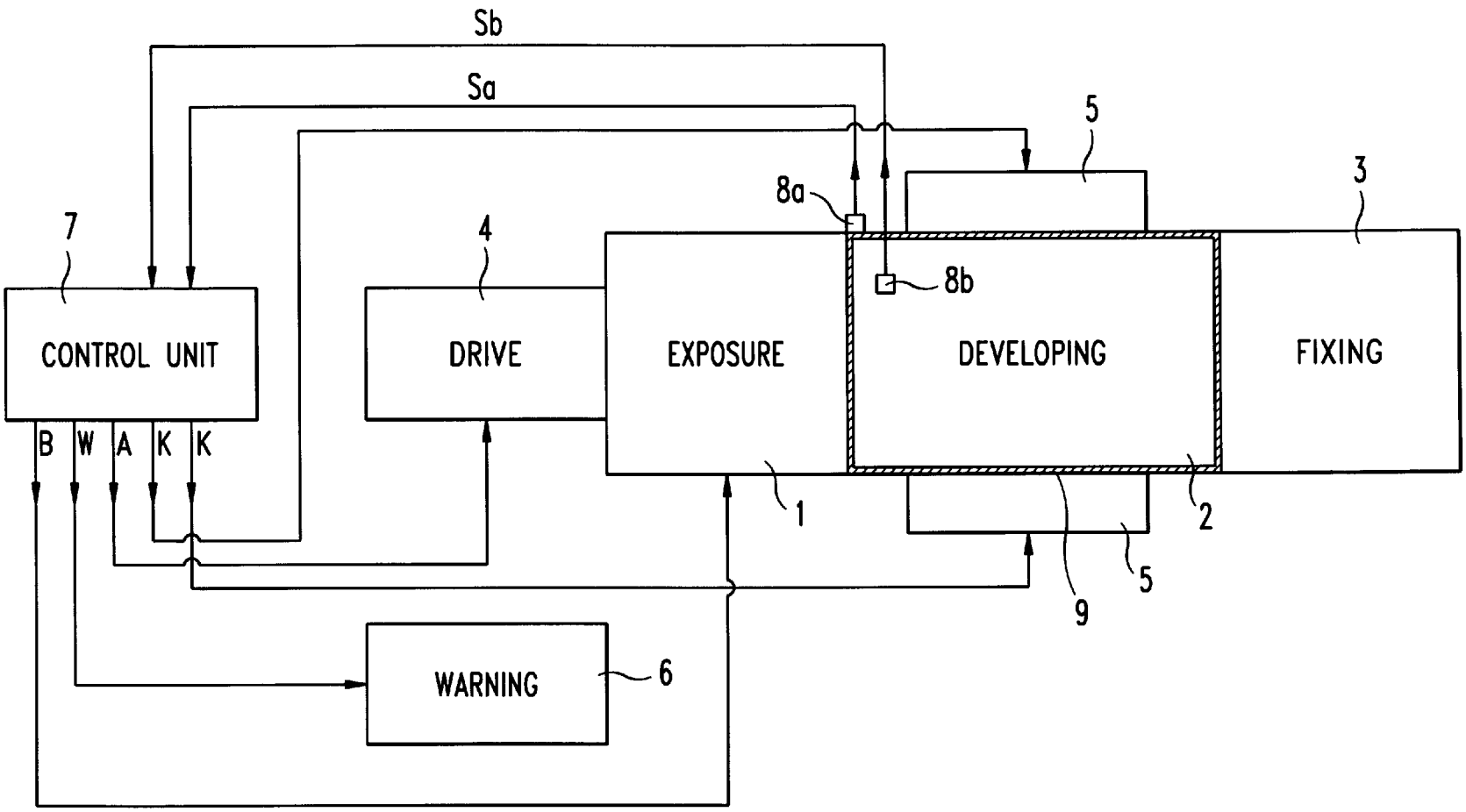
FIXING
DEVELOPING
EXPOSURE
DRIVE
WARNING
CONTROL UNIT
3
2
5
5
9
8b
8a
1
4
6
7
Sb
Sa
K
K
A
W
B

PROCESSING MACHINE WITH A TEMPERATURE SENSOR

BACKGROUND OF THE INVENTION

The present invention relates to an operational method for a developer station, in particular for an electrographically operating printer or copier, in which toner is supplied in a controlled manner to a developer and the two components are mixed to form a homogenous developer mixture.

DESCRIPTION OF THE RELATED ART

In electrography, also called xerography, an original to be duplicated is imaged, by means of exposure, on a uniformly charged semiconductor material with high dark resistance (also known as a photoconductor). The charge image that arises on the semiconductor material by partial discharge of the semiconductor material is exposed in the developer station to a powder material (developer/toner mixture) that consists of very fine particles of thermoplastic material that are standardly colored as needed, and that have previously been electrostatically charged. The particles thereby adhere to the still-charged points of the charge image, which thereby becomes visible. This powder image, or toner image, is then transferred onto an insulating print material, e.g. a sheet of paper, a film, or the like, by for example applying the print material onto the toner image and electrically charging it from the back. In the subsequent fixing station, the toner image transferred onto the print material is fixed, e.g. by means of heat, which causes the thermoplastic powder to melt, or by means of chemical solvents that are sprayed on.

In the developer station, toner is supplied to the developer in controlled fashion. In order to achieve a uniform distribution of toner, the two components must be mixed. This causes the temperature of the mixture to increase. In addition, temperature increases occur in the developer mixture due to supply of heat via already-fixed papers during duplex printing via the photoconductor. High external temperatures in the region of the developer station can also lead to an increase of temperature of the mixture.

If an upper limit temperature of the developer mixture of approximately 46° C. is exceeded, clots can occur in the developer mixture that lead to errors in the print image. In addition, the coloring of the photoconductor drum, which takes place in the developer station, and thus the print quality, change dependent on the operating temperature of the developer mixture. This is the case in particular after the activation of the apparatus during the transition from the first printing with a "cold mixture" to the "warmed-up for operation" apparatus.

German published patent document DE 38 18 352 A1 specifies an image production means with a developer station. The heat produced by the various aggregates is carried away to the outside. The image production means contains a temperature sensor whose signal controls a means for dissipating the heat dependent on the set temperature.

From Japanese patent document JP 61-120176 A (cf. abstract in "Pat. Abstr. JP Sect. P. 140, P 507), it is known to cool the developer station in order to keep the developer substance at a constant quality. The heat of an inner container that houses the developer station is carried away, with the aid of a liquid, to an outer container that surrounds the inner container, which outer container contains a thermoelectrical cooling element.

From the Japanese patent documents JP-A-58-083875, JP-A-62-050851 and JP-A-03-172876, respective developer stations are known in which the temperature of the developer mixture is determined directly or indirectly with the aid of temperature sensors. On the basis of the determined temperature, an operational variable of the developer station is generally influenced.

SUMMARY OF THE INVENTION

The present invention is based on the object of providing a method for a developer station that enables a print image that is as uniform as possible, independent of the operating temperature of the developer mixture.

This object is achieved by a method for monitoring and controlling the temperature of the developer station and its developer mixture, in particular of the developer/toner mixture of an electrographically operating printer or copier, having the following steps: production of a temperature signal of the developer/toner mixture by means of a temperature sensor, supplying of the temperature signal to a control unit, influencing of at least one operational variable of the developer station by the control unit on the basis of the temperature signal of the developer/toner mixture produced by the temperature sensor, the discharging of the photoconductor drums and the illumination strength of the exposure units being corrected individually on the basis of the acquired temperature of the developer mixture for the influencing thereof in order to obtain a maximally uniform print image from the first printing up to the apparatus warmed-up for operation.

The at least one temperature sensor is advantageously arranged in the developer/toner mixture. By this means, it can acquire the actual temperature of the mixture. Through the use of several sensors, a better assessment of the temperature situation in the developer station can be obtained independently of local temperature deviations.

In the invention, the temperature sensor is arranged on the housing of the developer station, whereby the housing is made of heat-conducting material. By this means, on the one hand local temperature peaks of the developer station that can lead to local clottings are compensated by the conducting of heat via the housing, and on the other hand a possibility of economical external attachment of the temperature sensor(s) is created.

In addition, at least one additional temperature sensor is arranged in the developer/toner mixture. This arrangement of sensors both on the housing and in the interior of the developer station is particularly advantageous if the temperature difference between the inner and the outer region is of interest specifically at the beginning of operation or after a forced pause in the ready-for-operation mode.

In the inventive method for monitoring and controlling the temperature of the developer station and its developer mixture, in particular of the developer/toner mixture of an electrographically operating printer or copier, the following steps are executed:

- production of a temperature signal of the developer/toner mixture by means of a temperature sensor
- supplying of the temperature signal to a control means
- influencing of at least one operational variable of the developer station by the control means, on the basis of the temperature signal, produced by the temperature sensor, of the developer/toner mixture.

According to the invention, the influencing of at least one operational variable is the correction only of the temperature of the developer station, e.g. by specific cooling using one or more cooling assemblies, or by means of temporary deactivation of the fixing station, and thus deactivation of the copying or printing operation.

According to the invention, the discharging of the photoconductor drums and the illumination strength of the exposure units is corrected individually on the basis of the acquired temperature of the developer mixture, in order, as mentioned above, to obtain a maximally uniform print image from the first printing ("cold mixture") up to the apparatus "warmed up for operation."

In a specific construction, the at least one operating variable is the temperature of the developer/toner mixture, and its influencing takes place by means of deactivation of the developer station if the temperature exceeds an upper boundary value. Clots are likewise avoided by this means. The entire copier and print operation is preferably halted. The copier or, respectively, printer can thereby remain in a ready-for-operation mode, until the temperature has again fallen below the upper boundary temperature.

Further advantages, features and possible applications of the invention result from the following specification of an embodiment on the basis of the drawing.

BRIEF DESCRIPTION OF THE DRAWINGS

A single FIGURE shows a schematic representation of a copier or printer system with an inventive developer station.

DETAILED DESCRIPTION OF THE PREFERRED EMBODIMENTS

The FIGURE schematically shows an inventive developer station 2 together with other adjacent stations of a printer or copier. A drive 4 drives the (not shown) rollers, drummers, etc., of an exposure station 1, of the developer station 2, and of a fixing station 3. A temperature sensor 8*a* is connected to the housing 9 of the developer station 2, and a further temperature sensor 8*b* is located in the interior of the developer station 2. Two cooling assemblies 5 are likewise arranged on the developer station 2. The signals obtained from the temperature sensors 8*a* and 8*b* are supplied to a control means 7. These signals are processed in the control means 7. Finally, another warning apparatus 6 is provided that displays a critical operating state of the system by means of an optical or acoustic signal.

On the basis of the obtained temperature signals Sa and Sb, the cooling assemblies 5 can be driven by the control means 7 by means of control signals K, in order to keep the temperature of the developer station 2 constant, for example by means of specific cooling. As mentioned above, this is important for a uniform print quality.

The control means 7 can also emit a control signal A that is supplied to the drive 4 in order to stop the drive 4, and thereby the entire system, as needed, in order for example to respond to an overheating of the developer station 2. At the same time, a control signal W can thereby also be emitted that produces the optical or acoustic warning signal in the warning apparatus 6. Finally, a control signal B can also be emitted that determines the illumination strength of the exposure unit 1.

By means of specific supplying of each of the cited control signals K, A, B or W to the respective units 5, 4, 1 or, respectively, 6, the temperature of the developer station 2 can be influenced either automatically or manually or, respectively, semi-automatically. Several of these control signals are preferably also used in combination in order to achieve an entirely specific influencing of the temperature in the developer station.

Although other modifications and changes may be suggested by those skilled in the art, it is the intention of the inventors to embody within the patent warranted hereon all changes and modifications as reasonably and properly come within the scope of their contribution to the art.

What is claimed is:

1. A method for monitoring and controlling a developer station and its developer mixture of a printer or copier, comprising the following steps:

producing a temperature signal of the developer mixture by a temperature sensor, supplying of the temperature signal to a control unit, and influencing at least one operational variable of the developer station by the control unit on a basis of the temperature signal of the developer mixture, said influencing including changing discharging of a photoconductor drum and illumination strength of an exposure unit individually on a basis of acquired temperature of the developer mixture to obtain a uniform print image from a first printing up to the printer or copier being warmed-up for operation.

2. A method as claimed in claim 1, wherein said temperature signal is produced by a plurality of temperature sensors.

3. A method as claimed in claim 1, wherein said temperature sensor is provided on a housing of said developer station.

4. A method as claimed in claim 1, wherein said temperature sensor is provided in said developer mixture.

5. A method for monitoring and controlling temperature of a developer station and its developer mixture of a printer or copier, comprising the following steps:

producing a temperature signal of the developer mixture by a temperature sensor, supplying of the temperature signal to a control unit, and influencing a temperature of the developer mixture by individually changing at least one of discharging of a photoconductor drum and illumination strength of an exposure unit individually on a basis of acquired temperature of the developer mixture to obtain a uniform print image from a first printing up to the printer or copier being warmed-up for operation and by providing at least one cooling unit to keep the temperature within an operational range.

6. A method as claimed in claim 5, wherein said temperature signal is produced by a plurality of temperature sensors.

7. A method as claimed in claim 5, wherein said temperature sensor is provided on a housing of said developer station.

8. A method as claimed in claim 2, wherein said temperature sensor is provided in said developer mixture.

9. A method for controlling temperature of a developer station of a printer or copier, comprising the steps of:

sensing a temperature of the developer station to generate a temperature signal;

comparing the temperature signal to a predetermined threshold; and inhibiting a developer mix in said developer station from reaching a clotting temperature by pausing operation of said printer or copier upon said temperature signal exceeding said predetermined threshold.

10. A method as claimed in claim 9, wherein said step of sensing the temperature of the developer station includes:

sensing a first temperature of a developer mix within the developer station; and sensing a second temperature of a housing of said developer station;

said step of comparing includes:

determining a temperature difference between said first and second temperature signals; and said step of inhibiting includes:

utilizing said temperature difference as a basis for pausing operation of said printer or copier.

11. A method as claimed in claim 9, wherein said pausing operation includes deactivating a fixing station of the printer or copier.

12. A method as claimed in claim 9, wherein said step of inhibiting includes controlling a cooling apparatus in thermal contact with said developer station.

13. A method for controlling temperature of a developer station of a printer or copier, comprising the steps of:

sensing a temperature of the developer station to generate a temperature signal;

comparing the temperature signal to a predetermined threshold; and controlling photoconductor discharge and exposure illumination strength during warm up from a cold start to a warmed up for operation condition on a basis of said temperature signal.

* * * * *